US008376827B2

(12) United States Patent
Cammegh et al.

(10) Patent No.: US 8,376,827 B2
(45) Date of Patent: Feb. 19, 2013

(54) ROULETTE WHEEL SYSTEM

(75) Inventors: Andrew Cammegh, Kent (GB); Richard Cammegh, Kent (GB)

(73) Assignee: Cammegh Limited, Kent (GB)

( * ) Notice: Subject to any disclaimer, the term of this patent is extended or adjusted under 35 U.S.C. 154(b) by 273 days.

(21) Appl. No.: 12/884,723

(22) Filed: Sep. 17, 2010

(65) Prior Publication Data

US 2011/0244939 A1 Oct. 6, 2011

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl. ..... 463/17; 463/16; 463/22

(58) Field of Classification Search ..... 463/17; 708/250

See application file for complete search history.

(56) References Cited

U.S. PATENT DOCUMENTS

| | | | | |
|---|---|---|---|---|
| 4,869,505 | A | 9/1989 | Manabe | |
| 5,540,442 | A * | 7/1996 | Orselli et al. | 463/17 |
| 5,588,650 | A | 12/1996 | Eman | |
| 5,743,798 | A * | 4/1998 | Adams et al. | 463/17 |
| 5,801,766 | A * | 9/1998 | Alden | 348/157 |
| 2002/0167126 | A1 | 11/2002 | De Raedt | |
| 2003/0114212 | A1 | 6/2003 | Mothwurf | |
| 2008/0113728 | A1 | 5/2008 | Okada | |
| 2008/0252004 | A1 | 10/2008 | Au-Yeung | |
| 2009/0117964 | A1 | 5/2009 | Tsukahara | |

FOREIGN PATENT DOCUMENTS

| | | | |
|---|---|---|---|
| CN | 101400414 | A | 4/2009 |
| GB | 2363731 | A | 1/2002 |
| GB | 2429928 | A | 3/2007 |
| JP | 2007/301103 | A | 11/2007 |
| JP | 2007301103 | A | 11/2007 |
| WO | WO-95/28996 | A1 | 11/1995 |
| WO | WO 2005/28996 | A1 | 11/1995 |
| WO | WO-01/55988 | A1 | 8/2001 |
| WO | WO 01/55988 | A1 | 8/2001 |

OTHER PUBLICATIONS

Search Report in corresponding GB0916310.6, Jan. 8, 2010.
Search report in EP 10176612.9.
Examination Report in GB 0916310.6, dated Oct. 19, 2012.

* cited by examiner

*Primary Examiner* — Michael Cuff
*Assistant Examiner* — Kevin Y Kim
(74) *Attorney, Agent, or Firm* — Barnes & Thornburg LLP

(57) ABSTRACT

A roulette wheel generates a first random number every game determined by the pocket into which a roulette ball falls. A second random number is generated every game from the motion of the ball, the wheel, or other factors.

6 Claims, 4 Drawing Sheets

ROULETTE WHEEL SYSTEM

The present invention relates to a roulette wheel system, i.e. a system including a roulette wheel or adapted for use with a roulette wheel.

BACKGROUND

Roulette is a well-known casino game which has been played for many years. A typical roulette wheel includes a number ring bearing a circular array of numbered segments bearing numbers 1 through 36. In addition, the number ring typically includes the numbers 0 and 00 disposed at diametrically opposite locations on the number ring, or a "0" on its own. The numbers 1 through 36 are not disposed in numerical order, but are typically disposed in a predetermined arrangement. The numbers disposed in a circular array in the number ring region of the wheel bear the alternating colours of red and black, with the exception of the 0 and 00 numbers, which are typically coloured green. A ring of pockets corresponding in number to the plurality of numbers of the circular number ring lies adjacent, but radially inward of the number ring, on the typical roulette wheel. In addition, a typical roulette wheel includes a circular, inclined ball track, disposed above, and radially outwardly of the number ring.

In operation of a typical roulette game, players place chips or tokens on a betting layout located on a roulette table, and then the croupier or dealer spins the roulette wheel to place the ball in motion about the circular ball track. As the wheel slows, the ball moves radially inwardly and comes to rest in one of the pockets associated with a particular number of the number ring. After the ball comes to rest in one of the pockets, the croupier or dealer settles the various wagers placed on the table layout in accordance with predetermined rules and wager odds and the process is repeated.

A computer-controlled display may be provided to display information about the game, including for example the winning number and previous winning numbers.

SUMMARY OF THE INVENTION

According to an aspect of the invention there is provided a roulette wheel system for use with a game of roulette in which for each game of roulette a ball is introduced to a rotating roulette wheel and settles in a pocket, the roulette wheel system comprising:

at least one sensor for determining which of a plurality of numbered pockets the ball falls into for the play of each game of roulette, for generating as a first random number the number of the pocket into which the ball falls; and a processor for generating a second random number from the information from the at least one sensor regarding the motion of the ball and/or the roulette wheel during the game.

In another aspect of the invention there is provided a method of operation of a roulette wheel having pockets associated with numbers, the method comprising:

introducing a ball into a ball track;

sensing the motion of the ball;

waiting for the ball to fall into a pocket of the roulette wheel to indicate a number associated with the pocket as a first random number;

generating a second random number from the sensed motion of the ball and/or rotor; and displaying the second random number.

By generating a second random number a variety of additional bets and gambling opportunities can be generated.

By generating the second random number from the same game that generates the first random number, the generation of the second random number does not add to the time taken to play each game. The second random number is not generated purely electronically, which increases the confidence of players and may in any event be required by gaming authorities.

By generating the second random number from the motion of the single ball and the roulette wheel, possibly with additional information, the generation of the first conventional random number is not affected in any way allowing those players who wish to play purely conventional roulette to do so.

The system may include the roulette wheel itself, the roulette wheel having a rotor and ball track. At least one sensor may be integrally mounted adjacent to the rotor to detect the motion of the ball.

Alternatively, the system may be separate from the roulette wheel and either be fed data from an automatic roulette wheel which generates data or may have a sensor to determine the motion of the ball. The sensor may in particular be a camera connected to image processing software.

The means for generating a second independent random number may generate the second independent random number for each game from at least one of the speed of the ball, the speed of the rotor and the first random number from a previous game.

In another aspect of the invention there is provided a roulette wheel for use with a game of roulette in which for each game of roulette a ball is introduced to a rotating roulette wheel and settles in a pocket, the roulette wheel comprising:

at least one sensor to sense the ball and/or the rotor;

a means for determining which of a plurality of numbered pockets the ball falls into for the play of each game of roulette from the information from the at least one sensor, to generate as a first random number the number of the pocket into which the ball falls;

a means for generating a second independent random number for the play of each game; and a controller adapted to output the first and second random numbers. By providing a second random number generator within the roulette wheel or controller, so that the output of the roulette wheel controller generates the second number, the apparatus according to this aspect can readily be connected in the same way as existing apparatus.

The roulette wheel is preferably a standard roulette wheel.

BRIEF DESCRIPTION OF THE DRAWING

Preferred embodiments of the invention will now be described with reference to the accompanying drawings in which.

The drawings are schematic and not to scale. Like or corresponding features may be given the same reference numbers in the different figures, and the description is not necessarily repeated.

DETAILED DESCRIPTION OF EMBODIMENTS OF THE INVENTION

Figure 1:
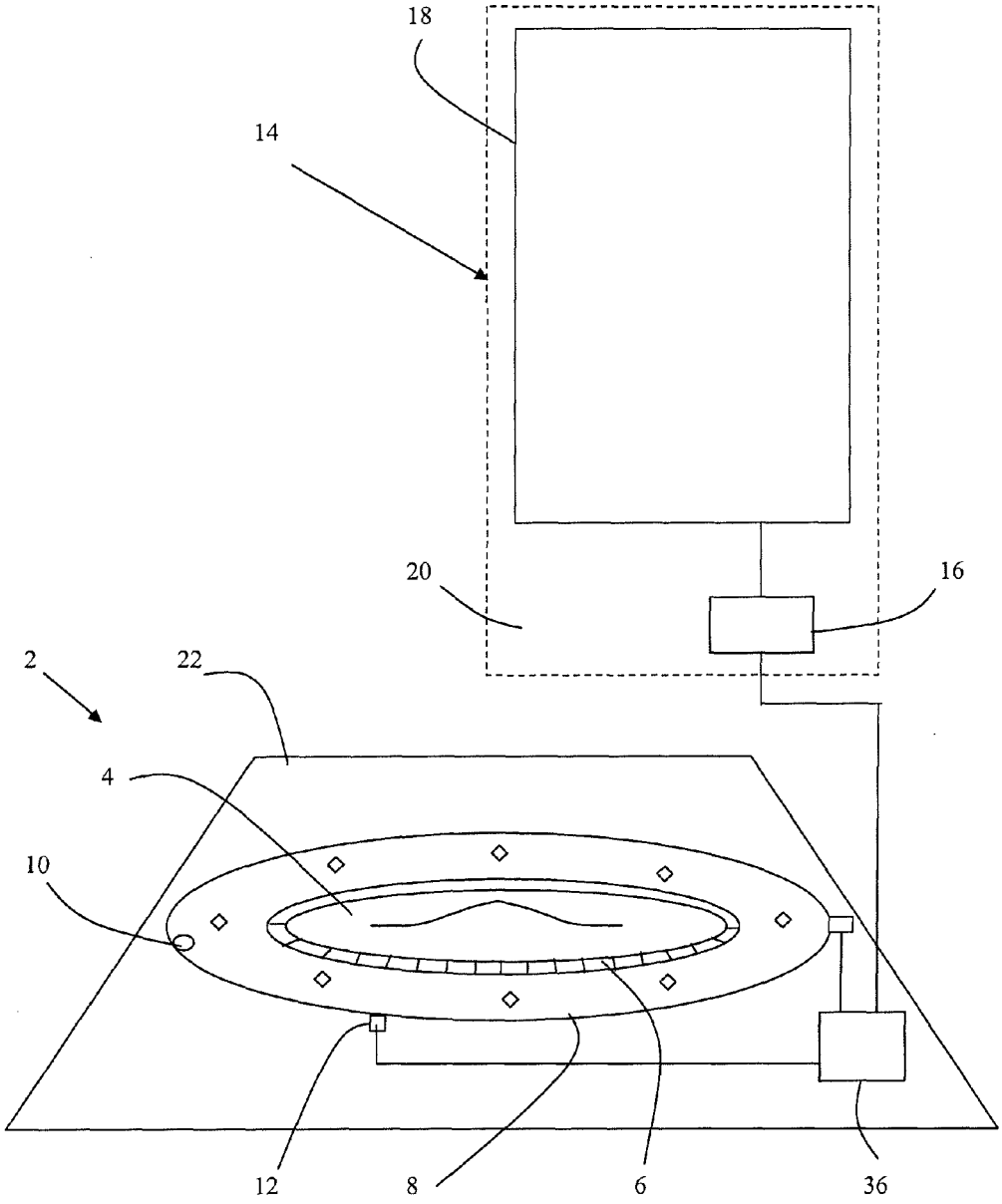
FIG. 1 shows a first embodiment of the invention.
Figure 2:
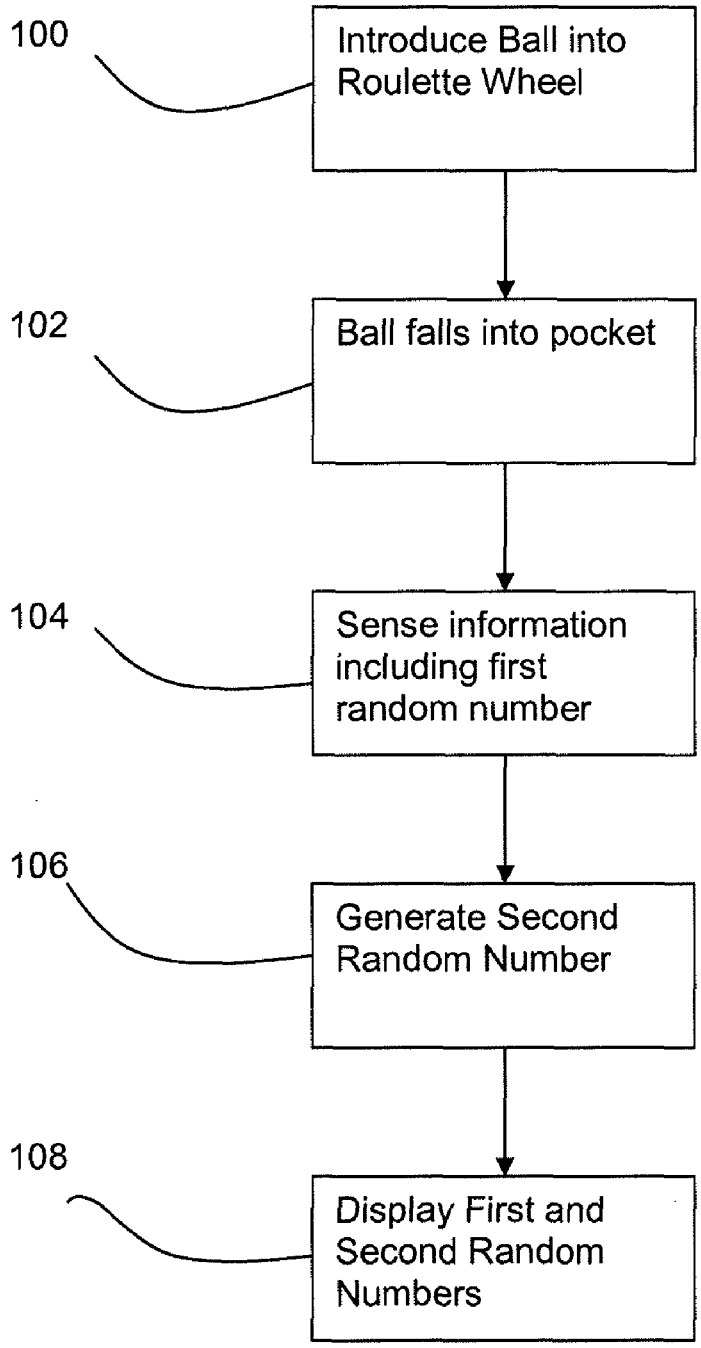
FIG. 2 is a flow diagram illustrating the operation of the first embodiment of the invention.

A roulette wheel 2 has a rotor 4 with pockets 6 on the periphery of the rotor. In accordance with convention, the pockets are numbered from 1 to 36 and with either a single 0 or a 0 and a 00 depending on local law and practice. The pockets numbered 1 to 36 are also traditionally coloured red and black. An integral roulette wheel controller 36 is also provided.

An inclined ball track 8 surrounds the rotor 4.

To play a game, the rotor 4 is rotated and a single ball 10 is introduced into the ball track 8 (step 100). Eventually, the ball 10 falls into a pocket which generates a random number 0, 00, or a number from 1 to 36 (Step 102). This number will be referred to as the first random number in this description.

Sensors 12 are provided to detect the ball, one on the rim to detect the ball in the ball track and at least one to detect which pocket the ball has arrived at. These sensors are connected to a display apparatus 14, which may also be termed a billboard. The display apparatus 14 includes a computer 16 and a display screen 18. Further sensors 12 detect the speed of the rotor.

The introduction of the ball 10 into the ball track 8 and the rotation of the rotor 4 may optionally be mechanised as is known in the art—these details will accordingly not be discussed further. Further conventional features of the roulette wheel such as a cover, ball interrupters to disrupt the flow of the ball and the like may also be included if required.

The roulette wheel sensors 12 detect (step 104) a number of pieces of information which are sent to the display apparatus 14. These pieces of information include the winning number, i.e. the number of the pocket into which the ball falls for each game, the first random number. Further information is also provided, including in particular the speed of the rotor and the speed of the ball. In the embodiment shown, the speed of the ball is determined in revolutions per minute (rpm) to two decimal places and and the speed of the rotor to one decimal place. Thus, the rotor speed may be measured as 18.2 rpm and the speed of the ball as 83.70 rpm.

The processor 36 takes the rotor speed, ball speed and the previous winning number and combines them (step 106) to produce a random number. In the embodiment, this random number is selected from the numbers labeling the pockets on the roulette wheel, namely 1 to 36, 0 and 00 if appropriate. Various parameters, including both random numbers and other information such as timing and speed information is output by the controller to the display 14.

The calculation may, for example, add the previous winning number (using 99 if there is no previous winning number) the speed of the rotor (to one decimal place) and the decimal part (to two decimal places) of the speed of the ball as measured initially when the ball is introduced, i.e. the speed of the rotor and ball that are used are the initial speed of the ball, the first measurements received after the ball is introduced. By using only the decimal part of the speed of the ball, greater randomness is introduced. It will be appreciated that the number of decimal places used may vary in alternative arrangements.

For example, if the speed of the ball is measured as 94.86 rpm, the speed of the rotor as 17.1 rpm, and the previous number 29, the calculation adds 171 (removing the decimal point), 29 and 86 to arrive at 286. The remainder modulo 37 (for a wheel with only a single "0") is then calculated as 27, which is accordingly the second random number. For a wheel with "0" and "00" the remainder modulo 38 may be calculated, and if the remainder is 37 the output is "00".

In alternative arrangements, the second random number is not just selected from the numbers on the wheel, but other numbers such as bonus numbers may be provided. This allows for the adjustment of odds and may also enhance player interest.

The computer is programmed to display the first and second random numbers on the display screen 18 (step 106), together with additional information which may include for example information from the casino.

A roulette table 22 is also provided; players may place bets by placing counters on the roulette table. In addition to the conventional bets on the numbers, even and odd, red and black etc. the roulette table also allows the opportunity to place bets on the second random number, including for example the second random number matching the first number or the second random number and the first random number both being a number selected by the player. This latter option may in particular allow the player the option of a bet with long odds, of order 1000-1, giving the chance of winning a jackpot with a small stake.

By providing both random numbers from a single spin of the wheel, i.e. a single game, the flow and speed of the conventional roulette game is not interrupted in any way and those players that wish to play purely conventionally may still do so.

Alternative ways of generating the second random number from each game may also be introduced. For example, the second random number may be generated from timing information, for example the time taken for the ball to be sensed as reversing direction from the time the ball is introduced into the roulette wheel. The timer may cycle rapidly through the available numbers, from 0, 00 (if applicable), and 1 to 36, for example cycling at a rate of one number every ms, or indeed any period for example in the range 0.1 ms to 20 ms.

Figure 3:
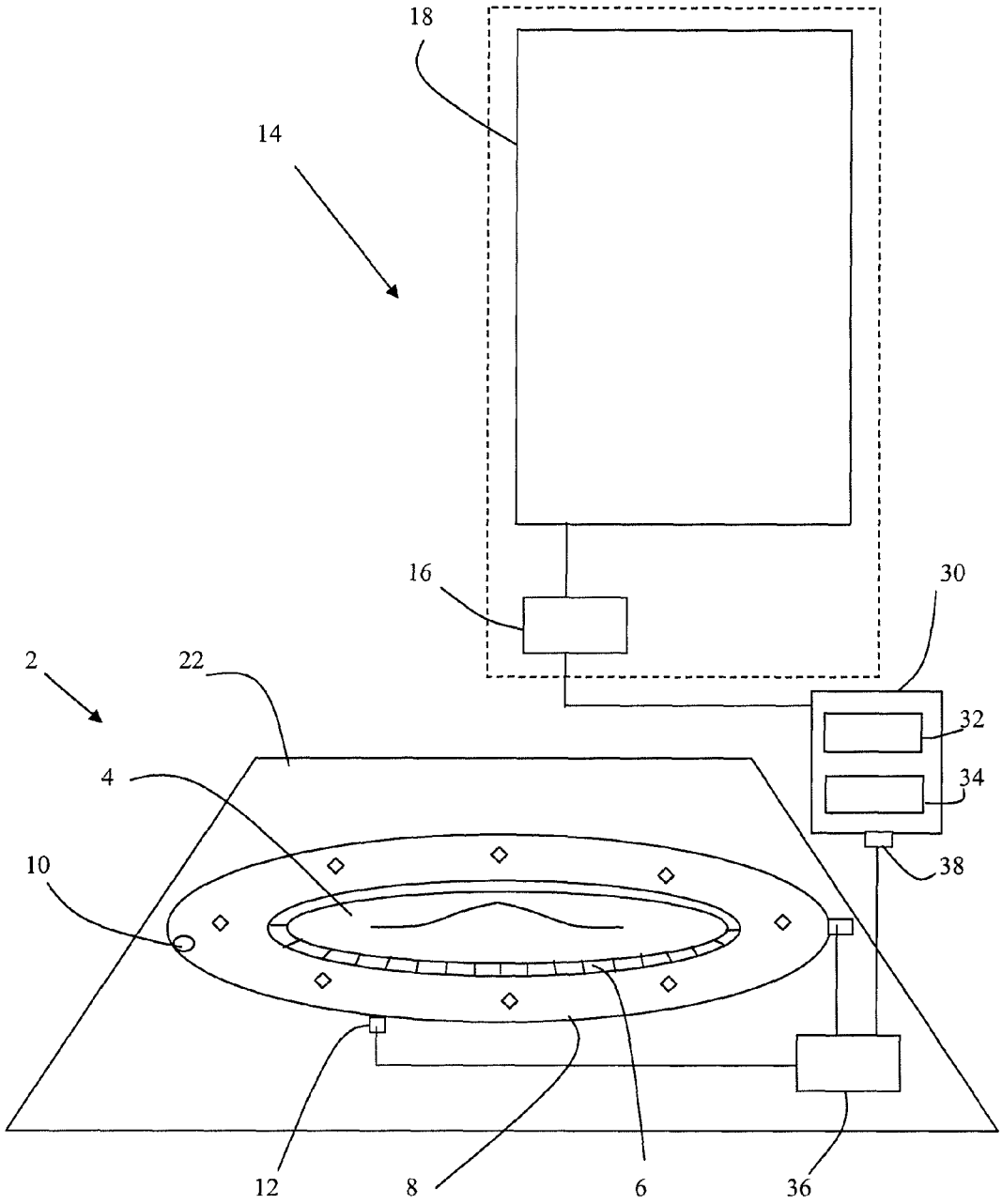
FIG. 3 shows a second embodiment of the invention.
Figure 4:
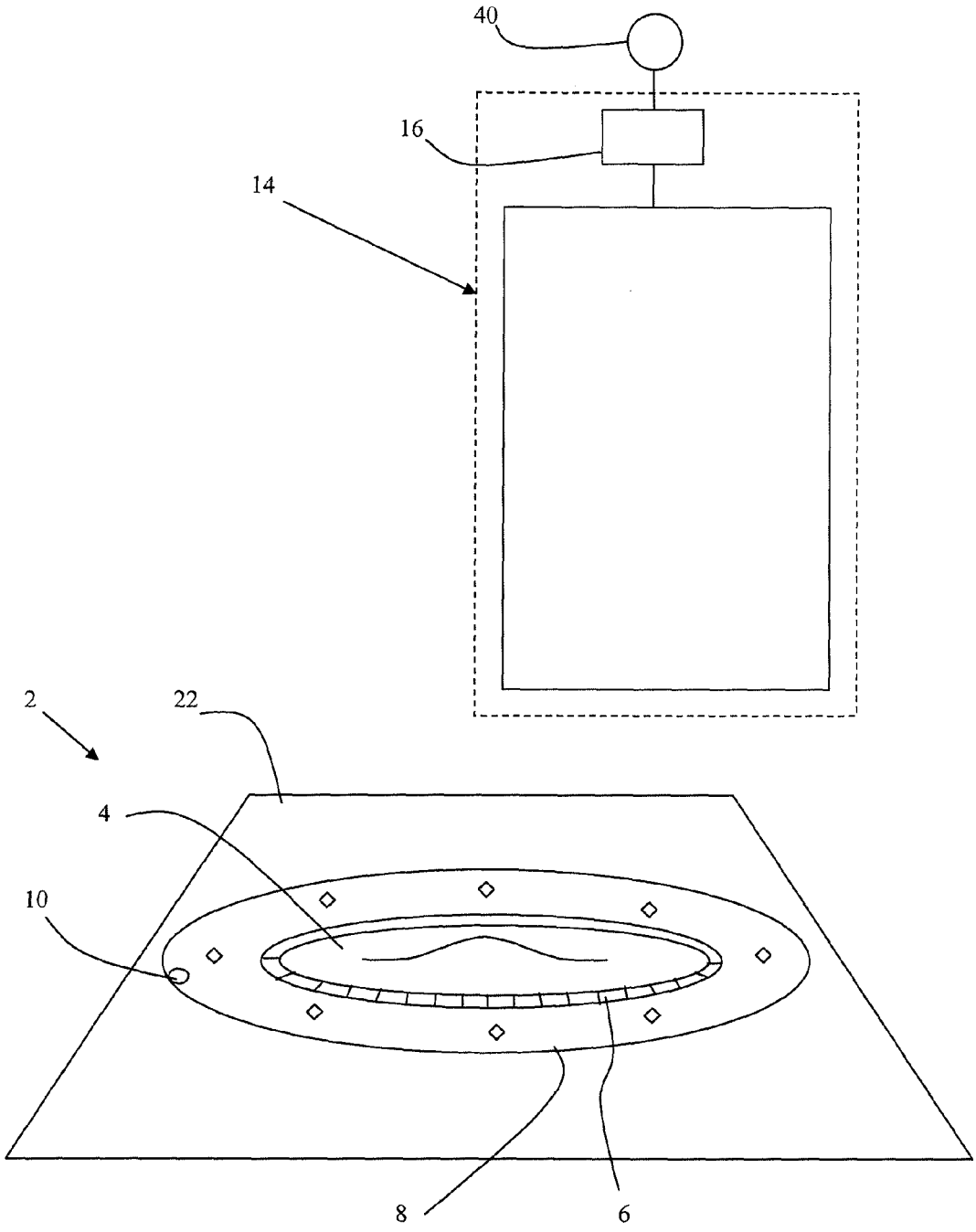
FIG. 4 shows a third embodiment of the invention.

In a second embodiment, illustrated in FIG. 3, the system is implemented as a single secondary processor 30 that connects to a standard output of a roulette wheel. Existing roulette wheels are available with a first processor 36 that electronically outputs data, including in particular the winning number, the speed of the rotor and the speed of the ball in the ball track. The secondary processor 30 includes a data input 38 for accepting the data, as well as a computer 32 including code 34 for carrying out the method as set out above, to generate the second random number and to output it to the display system 14.

In a third embodiment, illustrated in FIG. 34 the system is implemented by using a camera 40 attached to the display system 14. The camera is focused on the ball in the ball track, and the rotor. The camera is able to detect the winning number, the speed of the rotor and the speed of the ball. In this case, the computer 16 may include image analysis software to calculate the speed of the ball to two decimal places using a measurement period of about three seconds from the images from the camera. The camera feeds the information to computer 16 which calculates the second random number as set out above.

In a variant of the embodiments described above, it is possible to generate further random numbers, including for example a third, fourth or even a fifth random number. In preferred embodiments, these additional random numbers are generated from the motion of the ball in each game in a similar way to the second random number, though using different data. The built in security of using a wheel to generate the additional random numbers provides suitable levels of security, for the protection both of the casino and the players.

However, in alternative embodiments, one or more of the further random numbers, i.e. random numbers from the third on, are generated purely in software. The software may be provided wherever convenient, for example in the wheel, the wheel controller 36 or the display 14.

All the generated random numbers may be displayed on the display 14.

The invention may use any suitable roulette wheel, either manual or automatic.

Note that although the described embodiment includes first processor 36 and or second processor 30, the computer 16 includes a processor which may be used to carry out all of the processing by providing suitable software.

The invention claimed is:

1. A roulette wheel system for use with a game of roulette in which for each game of roulette a ball is introduced to a rotating roulette wheel and settles in a pocket, the ball being sensed by at least one sensor, the roulette wheel system comprising:

at least one processor to generate as a first random number the number of the pocket into which the ball falls from the information from the at least one sensor; and to generate a second independent random number from the information from the at least one sensor regarding the motion of the ball and/or the roulette wheel during the same game, wherein the processor generates the second independent random number for each game from at least one of the speed of the ball, the speed of the rotor and the first random number generated for a previous game.

2. A roulette wheel system according claim 1 further in which the sensor comprises a camera.

3. A method of operation of a roulette wheel having pockets associated with numbers, the method comprising:

introducing a ball into a ball track;

sensing the motion of the ball;

waiting for the ball to fall into a pocket of the roulette wheel to indicate a number associated with the pocket as a first random number;

generating a second random number from at least one of the speed of the ball, the speed of the rotor and a previous random number; and displaying the second random number.

4. A method according to claim 3 wherein the second random number is displayed a short time after the first random number.

5. A method according to claim 3 wherein sensing the motion of the ball includes sensing the speed of the ball using a sensor integrally mounted adjacent to the rotor.

6. A method according to claim 3 wherein sensing the motion of the ball includes sensing the speed of the ball using a camera.

* * * * *